US005828355A

United States Patent [19]

Comeau et al.

[11] Patent Number: 5,828,355

[45] Date of Patent: Oct. 27, 1998

[54] GENERAL PURPOSE LIQUID CRYSTAL DISPLAY CONTROLLER

[75] Inventors: Guillaume Gérald Comeau, Ottawa; Francois Blouin, Hull, both of Canada

[73] Assignee: Northern Telecom Limited, Montreal, Canada

[21] Appl. No.: 733,108

[22] Filed: Oct. 16, 1996

[51] Int. Cl.[6] ..... G09G 3/20

[52] U.S. Cl. ..... 345/59; 345/87

[58] Field of Search ..... 345/87, 189, 190, 345/201, 55, 59, 25, 26, 192

[56] References Cited

U.S. PATENT DOCUMENTS

| | | | |
|---|---|---|---|
| 4,839,638 | 6/1989 | Kosler et al. | 340/784 |
| 5,293,586 | 3/1994 | Yamazaki et al. | 395/164 |

FOREIGN PATENT DOCUMENTS 4343294 6/1995 Germany .

*Primary Examiner*—Matthew Luu

[57] ABSTRACT

A general purpose Liquid Crystal Display controller apparatus for controlling an LCD driver is operable to control an LCD having a plurality of individually addressable pixels arranged in lines. The apparatus has a pixel group generator for generating a pixel group for addressing respective groups of pixels on the lines of the LCD and a display buffer for storing image codes representing a desired image to be displayed on the LCD, the image codes being accessed in response to respective pixel groups. An identifier is provided for identifying each of the image codes as being a direct pixel group control code or a character addressing code and a character table is provided for storing character sub-line codes for controlling pixels in an addressed group, the character sub-line codes being accessed in response to the character addressing codes. The apparatus further includes a code provider for determining whether the image code associated with a pixel group is a direct pixel control code or a character addressing code. When the image code is a direct pixel control code, controlling the addressed group of pixels is controlled with the direct pixel control code and when the image code is a character addressing code, the character table is addressed with the character addressing code and the addressed group of pixels is controlled with a character sub-line code from the character table.

44 Claims, 5 Drawing Sheets

136

144

| | Location | Code | (Binary) |
|---|---|---|---|
| 190 | 176 | 20 | 00100000 |
| | 178 | 50 | 01010000 |
| | 180 | 88 | 10001000 |
| | 182 | F8 | 11111000 |
| | 184 | 88 | 10001000 |
| | 186 | 88 | 10001000 |
| | 188 | 88 | 10001000 |
| | 194 | 00 | 00000000 |
| 192 | 176 | F0 | 11110000 |
| | 178 | 88 | 10001000 |
| | 180 | 88 | 10001000 |
| | 182 | F0 | 11110000 |
| | 184 | 88 | 10001000 |
| | 186 | 88 | 10001000 |
| | 188 | F0 | 11110000 |
| | 194 | 00 | 00000000 |
| 142 | 176 | 30 | 00110000 |
| | 178 | 48 | 01001000 |
| | 180 | 80 | 10000000 |
| | 182 | 80 | 10000000 |
| | 184 | 80 | 10000000 |
| | 186 | 48 | 01001000 |
| | 188 | 30 | 00110000 |
| | 194 | 00 | 00000000 |

198 200 202 204 206 217

Fig. 3

220

```
1  Initialization
2  toggle frame signal
3  SET first line active for one clock cycle
4  RESET Row Counter register (00B)
5  WHILE row counter ≤ # of rows
6    RESET line counter register  (000B)
7    WHILE line counter ≤ # lines defining character height
8      Set latch active for one clock cycle
9      RESET group counter register (0B)
10     WHILE group counter ≤ # characters per row
11       Combine row counter contents and group counter contents
12         to produce a fixed group address
13       IF fixed group address is in first range
14         Combine character addressing code and line address to
15           produce character table address
16         Obtain character sub-line code from character table
17         Copy character sub-line code to effect processor
18         register
19       ELSE
20         Obtain direct pixel control code from display buffer
21         Copy direct pixel control code to effect processor
22         register
23       END IF
24         Wait for communication interrupt
25     Increment group counter
26     END WHILE
27   Increment line counter
28   END WHILE
29 Increment row counter
30 END WHILE
31 GOTO statement 2
```

| | |
|---|---|
| Row Counter Register | 230 |
| Line Counter Register | 232 |
| Group Counter Register | 234 |
| Effect Processor register | 236 |

Fig. 4

GENERAL PURPOSE LIQUID CRYSTAL DISPLAY CONTROLLER

BACKGROUND OF THE INVENTION

This invention relates to liquid crystal display controllers.

The control of a liquid crystal display (LCD) glass is commonly achieved through either character control or bit map control. Character control is used where characters are to be displayed and bit map control is used where icons or graphic representations are to be displayed.

Character control involves the use of a character table and codes are presented to the table which produces pixel control codes for controlling individual pixels on the LCD glass. The characters to be displayed typically include those of the alphabet and numbers and therefore the set of characters is finite with a relatively small number of different characters.

Bit map control involves the production of a bitmap image represented by codes having bits which indicate which pixels on the glass are to be visible and which are to be invisible. The bit map codes are then forwarded to a display driver and used to control the individual pixels or icons.

Often however, it is desirable to display both characters and icons or both characters and graphics. This normally requires a bitmap controller which presents an inefficiency because bitmap controllers require more memory to display characters resulting in an inefficient use of memory.

SUMMARY OF THE INVENTION

In accordance with one aspect of the invention, there is provided a general purpose Liquid Crystal Display controller apparatus for controlling an LCD driver operable to control an LCD having a plurality of individually addressable pixels arranged in lines. The apparatus has a pixel group generator for generating a pixel group for addressing respective groups of pixels on the lines of the LCD and a display buffer for storing image codes representing a desired image to be displayed on the LCD, the image codes being accessed in response to respective pixel group addresses. An identifier is provided for identifying each of the image codes as being a direct pixel control code or a character addressing code and a character table is provided for storing character sub-line codes for controlling pixels forming sub-lines of a character to be displayed on the LCD in response to the character addressing code. The apparatus further includes a processor for controlling the addressed group of pixels with the direct pixel control code when the identifier identifies the image code as a direct pixel control code and for controlling the addressed group of pixels with a character sub-line code from the character table when the identifier identifies the image code as a character addressing code.

Preferably, the display buffer has a plurality of registers for storing the image codes, the plurality of registers being located in first and second address ranges, the direct pixel control codes being stored in registers within the first address range and the character addressing codes being stored within the second address range such that the address range from which a given image code is retrieved identifies the code as being either a direct pixel control code of a character addressing code.

Preferably, the pixel group includes a row address portion for addressing a plurality of lines to define a row on which characters are to be represented and preferably, the pixel group generator includes a row address generator for generating the row address portion.

Preferably, the pixel group includes a line address portion for addressing a line included in the row and preferably, the pixel group generator includes a line address generator for generating the line address portion.

Preferably, the pixel group includes a position portion for addressing a position along the line, the position being associated with the group of pixels and Preferably, the pixel group generator includes a position address generator for generating the position portion.

Preferably, the display buffer is responsive to the row address portion and the position portion of the pixel group.

Preferably, the character table has a plurality of registers addressable in groups, each group being associated with a respective character and each register of a given group being operable to store a respective sub-line code associated with a character associated with the group.

Preferably, the character table is responsive to the character addressing code and the line address portion of the pixel group.

Preferably, the apparatus includes a programmable processor and a set of instructions operable to direct the programmable processor to implement the pixel group generator, and the code provider.

Preferably, the programmable processor includes a position counter register, a line counter register and a row counter register. Preferably, the set of instructions includes instructions operable to direct the programmable processor to increment the contents of the row counter register up to a first pre-defined value with the contents of the row counter register being incremented each time the line counter contents have been incremented to a second pre-defined value. Preferably, the set of instructions further includes instructions operable to increment the line counter contents up to the second pre-defined value after the position counter contents have been incremented to a third pre-defined value, the line counter register contents being incremented each time the position counter contents have been incremented to the third pre-defined value, the position counter contents being incremented after each direct pixel control code or character subline code is forwarded to the LCD driver.

Preferably, the first pre-defined value corresponds to the number of rows of characters to be displayed on the LCD, the second pre-defined value corresponds to the number of lines in each row, and the third pre-defined value corresponds to the number of pixel groups in a line.

Preferably, the apparatus includes a set of instructions operable to direct the programmable processor to produce interface signals including a clock signal having a plurality of signal transitions for signalling to the driver that a next successive pixel on the LCD is to be addressed, a first line signal for indicating to the LCD driver when a first line of the LCD is to be addressed, a latch signal for indicating to the LCD driver when a next line of the LCD is to be addressed and a polarity reversal signal for periodically directing the LCD driver to change the polarity of a reference voltage provided to the LCD.

Preferably, the respective groups of pixels are successively addressed such that the direct pixel control codes and the character sub-line control codes associated with the groups are repeatedly provided to the LCD driver at a time interval.

Preferably, the apparatus includes an effects processor for altering the interval at which at least one bit in the direct pixel control code or at least one bit of the character subline code is provided to the LCD driver to provide a visual effect to the image displayed by the LCD.

Preferably, the apparatus includes a data signal generator for generating a data signal for providing to the LCD driver an indication of whether an addressed pixel is to be visible or invisible, in response to a corresponding bit in the direct pixel control code or the character subline control code.

Preferably, the apparatus includes a clock signal generator for generating a clock signal having a plurality of signal transitions for signalling to the driver that a next successive pixel on the LCD is to be addressed.

Preferably, the apparatus includes a first line signal generator for generating a first line signal for indicating to the LCD driver when a first line of the LCD is to be addressed.

Preferably, the apparatus includes a latch signal generator for generating a latch signal for indicating to the LCD driver when a next line of the LCD is to be addressed.

Preferably, the apparatus includes a polarity reversal signal generator for generating a polarity reversal signal for directing the LCD driver to change the polarity of a reference voltage provided to the LCD.

Preferably, the apparatus includes a programmable processor and a set of instructions operable to direct the programmable processor to implement the pixel group generator, and the code provider.

Preferably, the apparatus includes a set of instructions operable to direct the programmable processor to successively address the respective groups of pixels such that the direct pixel control codes and the character sub-line control codes are repeatedly provided to the LCD driver at an approximately constant interval.

Preferably, the apparatus includes a set of instructions operable to direct the programmable processor to implement an effects processor by altering the interval at which at least one bit in the direct pixel control code or at least one bit of the character subline code is provided to the LCD driver to provide a visual effect to the image displayed by the LCD.

Preferably, the apparatus includes a set of instructions operable to direct the programmable processor to produce interface signals including a clock signal having a plurality of signal transitions for signalling to the driver that a next successive pixel on the LCD is to be addressed, a first line signal for indicating to the LCD driver when a first line of the LCD is to be addressed, a latch signal for indicating to the LCD driver when a next line of the LCD is to be addressed, a polarity reversal signal for directing the LCD driver to change the polarity of a reference voltage provided to the LCD.

In accordance with another aspect of the invention, there is provided a method of controlling a Liquid Crystal Display controller operable to control an LCD having a plurality of individually addressable pixels arranged in lines, the method comprising the steps of:

generating a pixel group address for addressing respective groups of pixels on the lines of the LCD;

storing image codes in a display buffer, the image codes representing a desired image to be displayed on the LCD and the image codes being accessed in response to respective pixel group addresses;

identifying each of the image codes as being a direct pixel control code or a character addressing code;

storing character sub-line codes in a character table, the character sub-line codes for controlling pixels forming sub-lines of a character to be displayed on the LCD in response to the character addressing code; and controlling the addressed group of pixels with the direct pixel control code, when the image code is a direct pixel control code; and addressing the character table with the character addressing code and controlling the addressed group of pixels with a character sub-line code from the character table when the image code is a character addressing code.

BRIEF DESCRIPTION OF THE DRAWINGS

In drawings which illustrate embodiments of the invention,

FIG. 3 is a pictorial representation of a character table according to the first embodiment of the invention;

FIG. 4 is a listing of program steps and related registers, in a pseudo code format, for performing an algorithm according to the first embodiment of the invention.

DETAILED DESCRIPTION

Figure 1:
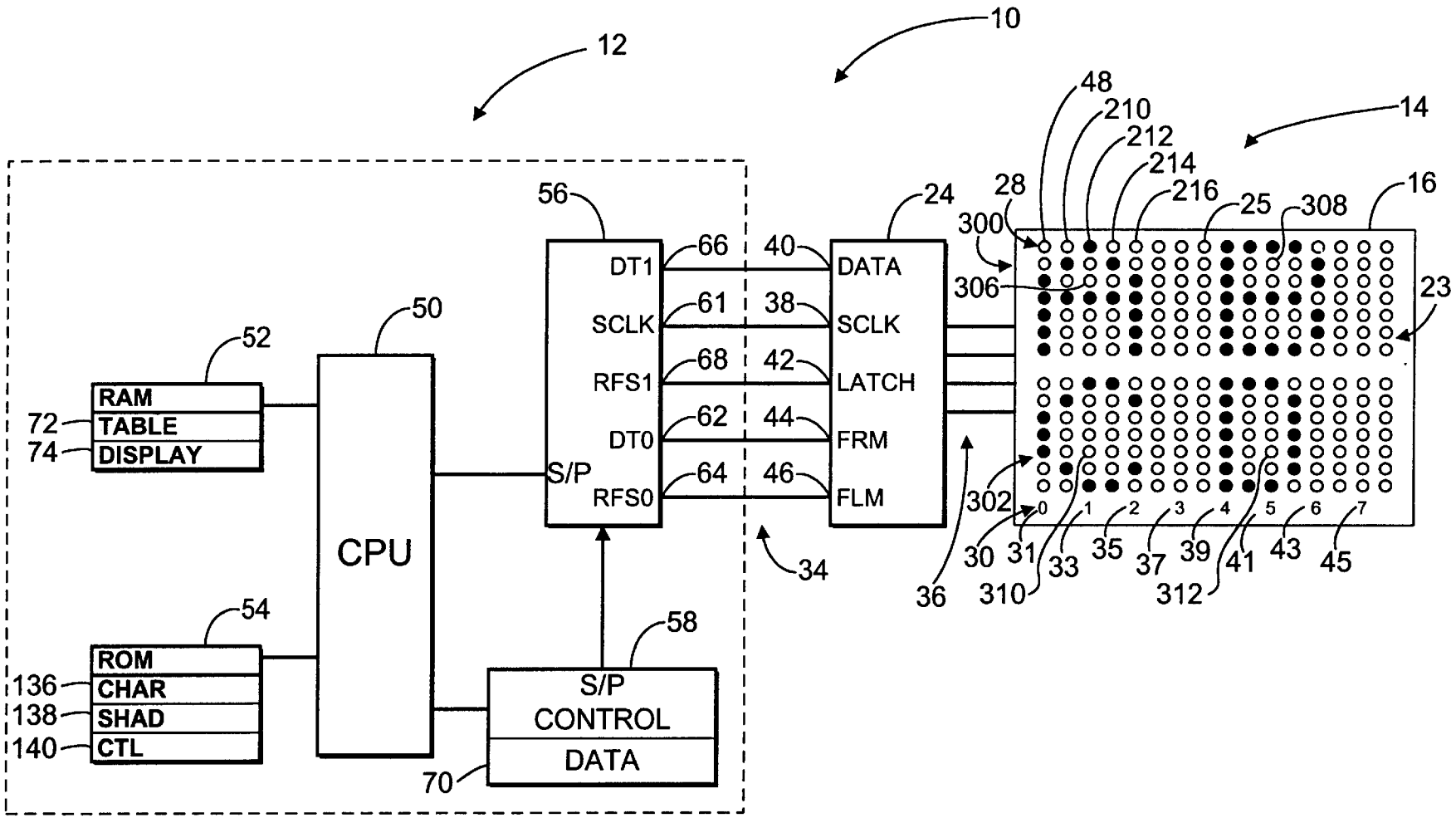
FIG. 1 is a block diagram of an apparatus according to a first embodiment of the invention.

Referring to FIG. 1, an apparatus according to a first embodiment of the invention is shown generally at 10. The apparatus includes a general purpose programmable device, which in this embodiment includes an Analog Devices ADSP-2101 signal processor labelled 12. The apparatus is shown connected to a liquid crystal display (LCD) shown generally at 14, the LCD including an LCD glass 16 and an LCD driver 24.

LCD Glass

The LCD glass 16 used in this embodiment has an array 23 of pixels 25 shown generally at 26, arranged in a plurality of lines 28. In this embodiment, each line includes sixteen pixels arranged horizontally in the orientation shown in FIG. 1. There are fourteen of such lines.

The display glass 16 also has a line or row 30 of icon pixels or icons 31, 33, 35, 37, 39, 41, 43, and 45, which, in this embodiment include pictorial representations of the numbers 0–7. It will be appreciated that other icons may be used, such as graphical images of a telephone, a bell, etc.

LCD Driver

The driver 24 is directly connected to the LCD glass 16 and has a plurality of inputs 34 and a plurality of outputs 36. The outputs 36 interface directly with the glass 16 and provide thereto, signals operable to address and control each individual pixel 25 and icon 31, etc.

The inputs 34 include terminals identified as clock (SCLK) 38, data (DATA) 40, latch (LATCH) 42, frame (FRM) 44 and first line marker (FLM) 46. The clock terminal SCLK 38 is operable to receive a clock signal having a frequency of approximately 1 kHz, in response to which the driver 24 renders active the outputs 36 to address successive pixels 25 and icons 31 etc. with each clock cycle. The data terminal DATA 40 is operable to receive data in a serial format and the driver 24 renders active appropriate outputs 36 to cause the pixel 25 or icon 31 etc. addressed by the clock cycle currently in progress to be rendered visible or invisible. The latch terminal LATCH 42 is operable to receive a latch signal which is used to reset the addressing of the lines of pixels to the first pixel of the next line. The frame terminal FRM 44 is operable to receive a frame signal to signal the driver 24, to change the polarity of a reference voltage provided to the LCD. The first line marker terminal FLM 46 is operable to receive a first line marker signal in response to which the driver 24 asynchronously resets the addressing of the outputs 36 to the first line of pixels or icons in the display.

DSP

Referring back to FIG. 1, the digital signal processor 12 includes a central processing unit (CPU) 50, Random Access Memory (RAM) 52, Read Only Memory (ROM) 54, a serial port 56 and serial port control registers 58. Internal buses are provided for communication between the CPU 50, the RAM 52, the ROM 54 and serial port control registers 58. In this embodiment, the CPU 50 is operable to execute 2 million instructions per second, the ROM 54 is capable of storing 2K words of program instructions and the RAM is capable of storing 330 8-bit words of data.

The serial port 56 has outputs SCLK0/SCLK1 61, DT0 62, RFS0 64, DT1 66 and RFS1 68 which are connected to terminals SCLK 38, FRM 44, FLM 46, DATA 40 and LATCH 42 respectively, of the driver 24. The serial port outputs are operable to produce the clock, data, latch, frame and first line marker signals respectively, at voltage and current levels compatible with the driver.

Figure 2:
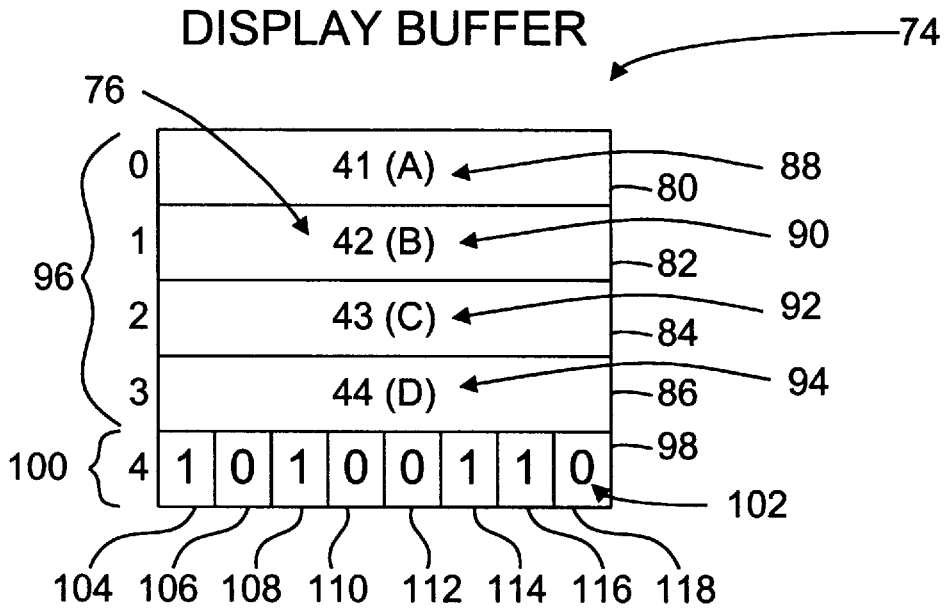
FIG. 2 is a pictorial representation of a display buffer according to the first embodiment of the invention.

Referring to FIGS. 1 and 2, the serial port 56 and the respective states of the outputs SCLK0/SCLK1 61, DT0 62, RFS0 64, DT1 66 and RFS1 68 are controlled by the serial port control registers 58. Generally, the CPU 50 writes commands to the serial port control registers 58 to invoke specific functions of the serial port to cause the outputs SCLK0/SCLK1 61, DT0 62, RFS0 64, DT1 66 and RFS1 68 to be rendered active or inactive. As is common with serial ports, commands for specifying the frequency and duty cycle of the clock signal appearing at the SCLK0/SCLK1 output 61 determine these parameters of the clock signal. Once having specified these parameters the clock signal is produced continuously. Also as is common, data in the form of a data byte is written to a data register 70 of the serial port control registers 58 and the serial port 56 itself is configured to represent the individual bits of the data byte at the DT0 output 62 synchronously with the clock signal.

It will be appreciated that specific commands for writing to the serial port control registers 58 are provided in a user's manual entitled ADSP-2100 Family User's Manual published by Analog Devices Inc. of California, incorporated herein by reference.

RAM table pointer

Referring to FIG. 1, the RAM 52 has a table pointer portion 72 and a display buffer 74. The table pointer portion 72 includes registers used to store configuration data including codes representing the number of lines of pixels in the array, the number of pixels per line, the number of icons, and the like. These parameters are provided to the DSP 12 by an external application that can run on the DSP or on an external processor. It also includes registers for performing internal calculations.

display buffer

Referring to FIG. 2, the display buffer 74 has a plurality of registers 76 for storing image codes representing a desired image to be displayed on the LCD. The image codes are provided to the display buffer 74 by the external application.

The plurality of registers is located in first and second address ranges 96 and 100. Character addressing codes are stored in registers within the first address range 96 and are ultimately used to address a character table in the ROM which provides a code operable to control an addressed group of pixels. Direct pixel control codes are stored in registers within the second address range 100 and are used to directly control an addressed group of pixels. The address range of the display buffer 74, from which a given image code is retrieved, identifies the image code as being either a direct pixel control code or a character addressing code.

ROM

Referring back to FIG. 1, the ROM 54 includes the character table 136, a shading portion 138 and a control logic portion 140.

Referring to FIGS. 1 and 3, the character table 136 has a plurality of addressable table registers only some of which are shown generally at 142, for storing character sub-line codes 144 for controlling the on/off states of pixels within an addressed group of pixels.

In this embodiment, the character sub-line codes 144 are stored in groups associated with an ASCII character. Each ASCII character is assumed to be representable by controlling the on/off states of pixels in respective portions of seven consecutive lines on the display, where each portion has 8 pixels. Each respective portion therefore may be thought of as a sub-line having 8 pixels. Thus, respective separate bytes of data may be used to control corresponding sub-lines of pixels, where each individual bit of a given byte is used to control a corresponding pixel of a sub-line. Such separate bytes are what are referred to herein as character sub-line codes.

Each ASCII character is thus represented by seven character sub-line codes and it is a matter of retrieving these codes at the appropriate time to cause a character to be displayed on the LCD.

In this embodiment, the character sub-line codes for a given character are stored in a respective group of registers which are located successively linearly in an address space of the ROM. This simplifies the addressing of the character table as most significant signal lines can be used to address the character while least significant signal lines can be used to address the individual registers within each group.

Referring back to FIG. 1, the shading portion 138 includes shading codes operable to impart visual effects to the image displayed on the array. Boolean addition of the shading codes with respective character sub-line codes is used to produce effects such as shading and blinking, for example.

control logic

The control logic portion 140 includes a program comprised of instruction codes for directing the CPU 50 to cause the serial port to produce the signals DT0, SCLK/SCLK, RFS0, DT1 and RFS1, in response to image codes stored in the display buffer shown in FIGS. 1 and 2.

Referring to FIG. 4, the control logic includes instruction codes for directing the CPU to follow an LCD control algorithm 220 according to the first embodiment of the invention. This algorithm is expressed pseudo code. The manufacturer of the CPU produces a data sheet listing available instruction codes which can be used to direct the CPU to effect various functions. It will be appreciated that the algorithm 220 has a plurality of functional portions and that using the pseudo code it is possible to choose instruction codes from the manufacturer's data sheet to cause the CPU to effect such functional portions. These functional portions are expressed in simplified terms by the pseudo code which provides a generic understanding of the overall functionality of the algorithm, which may be used to enable one of ordinary skill in the art to select instruction codes from data sheets of other manufacturers of digital signal processors, micro-controllers or the like, enabling the apparatus to be implemented with other processes or a direct hardware implementation.

Referring to FIGS. 1 and 2, the overall objective of the algorithm is to direct the CPU 50 to interact with the RAM 52, ROM 54 and serial port control registers 58 to successively read image codes from the display buffer and to produce the DT0, SCLK/SCLK, RFS0, DT1 and RFS1 signals to direct the driver 24 to cause the LCD to display characters in the array 23 and to render selected icons visible or invisible.

Referring back to FIG. 4, the pseudo code includes a plurality of functional statements numbered 1–31 which generally define an order in which respective functional portions of the algorithm are implemented.

Referring to FIGS. 1 and 4, the algorithm includes a code fetching portion which begins with statement 1 which initializes any registers internal to the DSP of in RAM which will be used in calculations. The code fetching portion also directs the CPU 50 to read from the table pointer portion 72 to determine the number of lines in the array, the number of lines to comprise a text row, the number of pixels per line, and the number of pixels per group. This information is stored by the external application in appropriate registers accessible by the DSP.

Statement 1 also writes to the serial port control register 58 to render the clock signal appearing at the SCLK0/SCLK1 output 61 active with a frequency of approximately 15 kHz, depending upon the screen width. The frequency is calculated to be approximately equal to the number of pixels in the whole LCD multiplied by 60.

Statement 2 directs the CPU 50 to write to the serial port control register 58 to cause the serial port 56 to toggle the DT1 output terminal 66 to provide the FRAME signal to the driver to indicate to the driver 24 that the polarity of a reference voltage provided to the LCD is to be reversed.

Statement 3 directs the CPU 50 to write to the serial port control register 58 to set the RFS0 output 64 active for one clock cycle to provide the first line marker signal FLM to the driver 24 to indicate that the first line of the array is to be addressed.

Statement 4 directs the CPU to initialize a row counter register 230 having $2^n$ bit positions for representing the number of rows of text to be displayed, where $2_n$>/= the number of rows of text to be displayed.

Statements 5–30 implement a first loop which is executed once for each row of the display.

row address generator

Statements 4, 5, 29 and 30 act as a row address generator or row counter.

Statement 6 resets a line counter register 232 having $2^n$ bit positions for representing the number of lines to comprise a text row, where $2_n$>/= the number of lines that make up a text row.

Statements 7–28 represent a second loop which is repeated for each line within a row. The second loop includes statement 8 which directs the CPU 50 to write to the serial port control registers 58 to cause the serial port 56 to render the RFS1 latch signal 68 active for one clock cycle to signal to the driver 24 that the next successive line of pixels is to be addressed. Statements 6, 7, 27 and 28 act as a line address generator.

Statement 9 causes the CPU to reset a group counter register 234 having $2^n$ bit positions for representing the number of groups of pixels on each line, where $2_n$>/= the number of groups.

Statements 10–26 represent a third loop which is executed once for each group in a line. Statements 9, 10, 25 and 26 act as a group counter.

Upon completion of Statement 10, the row counter, line counter and group counter registers 230, 232 and 234 have specific, fixed values, which, combined, act as a pixel group address.

Statements 11 and 12 then direct the CPU 50 to use the contents of the row counter register 230 and the contents of the group counter register 234 to produce a display buffer address to address the display buffer. The display buffer address is thus derived from the pixel group address. In this embodiment, the contents of the row counter register act as a most significant portion of the display buffer address and the contents of the group counter register act as a least significant address portion of the display buffer address. The row counter thus acts as a row address generator and the group counter acts as a group address generator.

Statements 13–23 direct the CPU 50 to perform a decision function on the display buffer address. At statement 13, if the display buffer address formed by the contents of the row counter and the group counter is within the first pre-defined address range (96 in FIG. 2), statements 14–15, direct the CPU 50 to use that display buffer address to obtain from the display buffer 74 a character addressing code stored at the corresponding register thereof and use that code in combination with the contents of the line counter register 232 to produce a character table address. The character table address is thus derived from the pixel group address.

Statement 16 uses the character table address to access a group of registers in the character table 136 such as group 190 in FIG. 3, and the contents of the line counter register 232 are used to access an individual register within the addressed group. The character table is thus responsive to the character addressing code and the line addressing portion of the pixel group address.

Statement 17 directs the DSP to retrieve the corresponding character sub-line code from the character table and copy it to an effects processor register 236.

If the display buffer address is within the second pre-defined range, (100 in FIG. 3), Statement 20 directs the DSP to use the display buffer address to address the display buffer to obtain the corresponding direct pixel control code stored at the addressed location. Statement 21 directs the DSP to copy the direct pixel control code to the effects processor register 236.

Processing then continues at statement 24 whereupon the CPU is directed to wait for a communications interrupt from the serial port. During the waiting period, an effects algorithm is run to produce a post effects code.

Effects Algorithm

Figure 5:
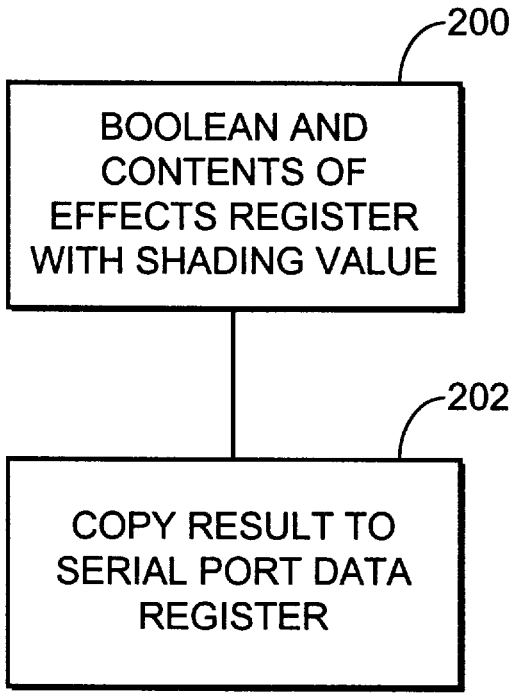
FIG. 5 is a flow diagram of an effects processor algorithm according to the first embodiment of the invention.

In this embodiment assume that the effects algorithm is for producing a dimmed or shaded display. Referring to FIG. 5, block 200 periodically performs a boolean AND function with the contents of the effects register and a code stored in the shading portion. If the code is 00H for example the code stored in the effects register 236 is set to 00 periodically. This may be done every 5th pass through the line, for example. The CPU 50 is thus directed to shade at least some of the pre-effect codes such that at least a portion of the image seen on the LCD appears shaded.

Other effects such as alternate pixel blinking may be produced by ANDing the contents of the effects processor register with other values to produce the post effects code. Such other values are also stored in the shading portion 138 of the ROM.

Following block 200, block 202 copies the post effects code stored in the effect processor register 236 to the data register 70 which acts as a buffer register for accumulating data to be sent to the display driver 24. The effects algorithm and CPU 50 thus act as an effect processor for imparting a visual effect to the pre-effect code, to produce a post-effect code, which is provided to the LCD driver.

Thus, the data register 70 is loaded asynchronously. Data in the data register 70, however, is transferred to the LCD driver synchronously with the clock signal 61. Each time a data byte is transferred to the display driver 24, the serial port invokes the communications interrupt which enables the LCD control algorithm 220 shown in FIG. 4 to proceed at statement 25. In effect, the FRM, FLM, LATCH and CLOCK signals produced by the serial port under the control of the LCD control algorithm act as interface signals for synchronizing the addressing of the LCD with the presentation of data for controlling individually addressed pixels.

At statement 25, the group counter register 234 is incremented and the "end while" statement at line 26 directs processing to continue back at statement 10. The pixel group address has thus changed. The contents of the row counter register are the same but the contents of the group counter register have been incremented to address the next group on the display and the above process is repeated.

Generally, each group on a line of pixels is successively addressed, then the next successive line is addressed and the respective groups on that line are addressed. This process is repeated for each line in a row, and then the next row is addressed, until all groups of all lines of each row have been addressed. It will be appreciated therefore, that upon the generation of a pixel group address, a corresponding code is retrieved either directly from the display buffer or from the character table. The code so retrieved is then processed to produce a post-effect code which is provided to the serial port. The individual bits of the post-effect code are used to control corresponding individual pixels of an addressed group. The serial port simply provides these bits to the driver in a serial format, synchronously with the clock signal and the interface signals are used to synchronize the addressing of pixel groups on the display with the retrieval of codes from the display buffer and character table.

Operation

Referring to FIG. 4, the operation of the apparatus will be described. In this embodiment, it is desired to display first and second rows 300 and 302 of two characters followed by a row 304 of icons. Each of the first and second rows includes 7 lines and each line is 16 pixels wide. The third row 304 has one line of 8 icon pixels.

Since each sub-line code consists of 8 bits, 8 pixels at a time may be addressed. Since there are 16 pixels on each line, two characters per line may be displayed in the array. Therefore first, second third and fourth characters 306, 308, 310, and 312 will be displayed.

Addressing of the pixels of the array is accomplished by addressing successive groups of 8 pixels on each line. Thus, there are two groups of 8 pixels on each line used to display the characters and there is one group of pixels on the line of icon pixels. In this embodiment however, the design is simplified because each of the seven sublines in each row are used to represent the same character. Therefore, the display buffer need only contain four registers in the first pre-defined address range, that is, one for each character, and one register in the second pre-defined address range that is, one for the group of icon pixels.

In this embodiment it is desired to display the characters A, B, C, D and to render visible icon pixels 0, 2, 5, and 6 and render invisible icon pixels 1, 3, 4, and 7. Therefore, an external application deposits into the display buffer 74, ASCII codes 41H, 42H, 43H, and 44H representing the characters A B C D. These ASCII codes are deposited in display buffer registers 80, 82, 84, and 86 respectively and act as character addressing codes. The first, second, third and fourth registers 80, 82, 84 and 86 are located contiguously within the first pre-defined address range 96 which, in this embodiment is 00b to 11b.

In addition, the host computer loads into the fifth display buffer register 98, the hexadecimal value A6, which acts as a direct pixel control code. The fifth display buffer register 98 is located in the second predefined address range 100, which in this embodiment is 100b. The direct pixel control code 102 has eight bits 104, 106, 108, 110, 112, 114, 116, 118 and in this embodiment, each respective bit is used to render active or inactive a corresponding icon 31, 33, 35, 37, 39, 41, 43 and 45 in the row 30 of icons.

The character addressing codes are distinguishable from the direct pixel control codes by the address ranges in which they are stored, the character addressing codes being stored in the first pre-defined address range and the direct pixel control codes being stored in the second pre-defined address range.

It will also be assumed that initialization parameters including the number of lines 28 in the array 23 (ie 14), the number of pixels 25 per line 28 (ie.16), the width and height of each character (ie. 8×7), the number of lines 28 of icons 31, etc., in the glass 16 and information such as the clock frequency (1 kHz) for synchronizing the digital signal processor to the driver 24, have been stored in the table pointer portion 72.

Referring back to FIG. 3, as ASCII codes have been chosen to represent characters to be displayed, the character table 136 has seven memory registers 176, 178, 180, 182, 184, 186, 188 for each ASCII code, where each of the seven registers 176–188 is used to store a respective pixel control byte for controlling pixels in a respective subline 162–174 (in FIG. 1) of the character.

For addressing simplicity, the character table 136 is organized into groups of eight registers 176–188 and 194, each capable of storing an 8-bit control code 144. Exemplary first and second groups of registers are shown at 190 and 192 respectively, where each group is associated with a corresponding unique ASCII character. Only seven of the eight registers 176–188 in each group are used, while the eighth 194 is ignored. Each of the seven used registers 176–188 is therefore used to store a respective character sub-line code for controlling respective sub-lines of the character to be displayed. Each character sub-line code includes first, second, third, fourth and fifth bits 198, 200, 202, 204, 206 which are used to control respective pixels 48, 210, 212, 214, 216 (shown in FIG. 1) in the corresponding sub-line of the character currently addressed. The remaining 3 bits 217 of each character sub-line code are set to 0 and provide a space between characters.

Referring to FIG. 3, the character table 136 is pre-loaded with character sub-line codes 144 in registers 176–188 of the first group for controlling the on/off states of pixels in respective pixel groups on sub-lines of the display. The character sub-line codes for the character "A" are stored in registers 176–188 of the first group 190 and character sub-line codes for the character "B" are stored in registers 176–188 of the second group 192. Similar character sub-line codes are stored in further registers associated with respective other ASCII characters.

Referring to FIGS. 1 and 4, the code fetching portion of the LCD control algorithm begins with statement 1 which initializes any registers which will be used in calculations. Statement 1 also writes to the serial port control register 58 to render the clock signal appearing at the SCLK0/SCLK1 output 61 active with a frequency of approximately 1 kHz.

Statement 2 directs the CPU 50 to write to the serial port control register 58 to cause the serial port 56 to toggle the DT1 output signal 66 to indicate to the driver 24 that the first row 147 is to be addressed.

Statement 3 directs the CPU 50 to write to the serial port control register 58 to set the RFS0 output 64 active for one clock cycle to signal to the driver 24 that the first line of the first row is to be addressed.

Statement 4 directs the CPU to initialize the row counter register 230 having two bit positions for representing the three rows of the display.

Statements 5–30 implement the first loop which is executed once for each row of the display. In the present embodiment, there are three rows and, therefore, the first loop is executed three times.

Statement 6 resets the line counter register 232 having three bit positions for identifying respective ones of the seven sublines of each character and statements 7–28 represent the second loop which is repeated for each line within a character. In this embodiment, there are 7 lines per character and, therefore, the second loop is executed 7 times. The second loop includes statement 8 which directs the CPU 50 to write to the serial port control registers 58 to cause the serial port 56 to render the RFS1 signal 68 active for one clock cycle to signal to the driver 24 that the next successive line of pixels is to be addressed.

Statement 9 causes the CPU to reset the group counter register 234 having one bit position for representing the two characters in each row and statements 10–26 represent the third loop which is executed once for each character in each row. In this case, there are two characters in each row of text and, therefore, the third loop is executed twice.

Upon completion of Statement 10, the row counter, line counter and character counter registers 230, 232 and 234 have specific, fixed values.

Statements 11 and 12 then direct the CPU 50 to use the row counter register contents and character counter register contents as the display buffer address. Since this is the first pass through the loop, the display buffer address is thus 000b.

At statement 13, the display buffer address is within the first pre-defined address range (96 in FIG. 2) and therefore, the character table 136 is addressed. To do this, the image code 88 stored in register 80 (display buffer address 0b) is used as the most significant portion of the character table address and the current contents of the line counter register are used as the least significant portion of the character table address.

Since the contents of display buffer register 80 are 41H, corresponding to the letter "A", the first group 190 of memory registers in the character table is addressed. Thus, the display buffer contents are used to address the group of character table registers corresponding to the ASCII character "A". The display buffer contents thus act as a character addressing code for addressing a group of characters table registers in the character table.

The line counter register contents are used to address individual registers within the group and therefore since the current contents of the line counter register 232 are 000b, the first register 176 is addressed. Referring to FIG. 3, the first register contains a pixel control code which acts as a character sub-line code having the value 20H.

Statement 16 directs the CPU 50 to read the addressed character table register and obtain the character sub-line code stored therein.

Statement 17 directs the CPU to copy the character sub-line code to the effect processor register 236. The value 20H is thus copied to the effect processor register as a pre-effects code. The processor thus controls the addressed group of pixels with a character sub-line control code from the character table when the image code is identified as a character addressing code by its address range in the display buffer.

Processing then continues at statement 24 whereupon the CPU is directed to wait for a communications interrupt from the serial port and during the waiting period, the effects algorithm is run to produce a post effects code.

Referring to FIG. 5, in this embodiment it is desired to produce a dimmed or shaded display. This is achieved by performing a boolean AND function with the pixel control code and the value 00H periodically to effectively blank the current group of pixels periodically. This is done by performing the boolean function on the contents of the effect processor register 236 every 5th pass through the line.

After performing the effects algorithm, the post effects code stored in the effect processor register 236 is copied to the data register 70 and the serial port transfers each bit of the post effects code synchronously with the clock signal to the display driver 24. After all bits of the post effect code have been transferred to the display driver 24, the serial port invokes the communications interrupt which enables the LCD control algorithm 220 shown in FIG. 4 to proceed at statement 25.

At statement 25, the group counter register 234 is incremented to 1b and the "end while" statement at line 26 directs processing to continue at statement 10.

Statements 11 and 12 then direct the CPU 50 to produce a new pixel address which is now 001b.

At statement 13, the new pixel address (001b) is still within the first address range (96 in FIG. 2), so statements 14–15, direct the CPU to retrieve from display buffer location 001b, the value 42H which is used as the most significant portion of the character table address. This value addresses the group of registers associated with the letter "A". As the current contents of the line counter register 232 remain unchanged (000b), statement 16 directs the CPU 50 to read the first register in the group to obtain the value F0H.

Statement 17 directs the CPU to copy F0H to the effect processor register, as the pre-effects code, where processing continues as explained above. The wait statement 24 is then invoked and the effects algorithm is run.

Upon completion of the transfer of pixel control codes corresponding to the first sublines of the characters to be displayed in the first row, statements 26 and 27 increment the line counter register 232 to 001b and the above steps are performed, beginning at statement 8, for the second sublines of the characters to be displayed on the first row. Statement 8 momentarily sets the LATCH signal active each time a new line is started to synchronize the driver 24 with the addressing of the character table. For the second sublines, registers 178 of the first and second groups 190 and 192 are addressed whereupon the pixel control codes 50H and 88H are forwarded to the effect processor register 236, processed and forwarded to the serial port. Similarly, for the third sublines, registers 180 of the first and second groups are addressed whereupon the pixel control codes 88H and 88H are forwarded to the effect processor register 236, as a pre-effects code which is then processed and forwarded to the serial port.

When the data for all seven sublines have been sent to the serial port, line 29 increments the row counter register 230 to 01b and the above steps are performed for each subline of each character in the second row of characters.

When the data for all characters of the second row have been sent to the serial port, statement 29 increments the row counter to 10b, and statement 30 returns processing to statement 5. Statement 6 resets the line counter register 232 to 000b, statement 8 momentarily sets the LATCH signal active, statement 9 resets the group register 234 to 0b and statements 11–12 produce a new pixel group address. The pixel group address is thus 100b which is in the second pre-defined address range 100. In this case statements 20–22 are invoked instead of statements 14–18 whereupon the display buffer register (98 in FIG. 2) is addressed and the direct pixel control code 102 (A6H) is copied to the effects register as a pre-effects code. Statement 24 then invokes the wait function, the effects algorithm is run and the result is copied to the serial port data register (70 shown in FIG. 1). Thus, the processor controls the addressed group of pixels with the direct control code when the image code is identified as a direct pixel control code by its address range in the display buffer.

Alternatives

It will be appreciated for a general application where the LCD has only an array of pixels arranged in lines the number of groups of pixels on each line can be changed simply by associating with each possible pixel group address a corresponding display buffer location in which is stored a respective image code which may be either a direct pixel control code or a character addressing code. Thus, pre-defined character display formats can be used with bit map graphics for controlling pixels on an LCD. The bit map graphics are provided by the direct pixel control codes and the character representations are provided by the character table.

It will be appreciated that with additional programming, after, say, 120 passes through the algorithm presented herein, the entire display buffer ranges can be re-defined to include only direct pixel control codes, if bit map operation only is desired or to include only character addressing codes if only text is to be displayed.

While specific embodiments of the invention have been described and illustrated, such embodiments should be considered illustrative of the invention only and not as limiting the invention as construed in accordance with the accompanying claims.

What is claimed is:

1. A general purpose Liquid Crystal Display controller apparatus for controlling an LCD driver operable to control an LCD having a plurality of individually addressable pixels arranged in lines, the apparatus comprising:

a) a pixel group address generator for generating a pixel group address for addressing respective groups of pixels on said lines of said LCD;

b) a display buffer for storing image codes representing a desired image to be displayed on said LCD, said image codes being accessed in response to respective pixel group addresses;

c) an identifier for identifying each of said image codes as being a direct pixel control code or a character addressing code;

d) a character table for storing character sub-line codes for controlling pixels forming sub-lines of a character to be displayed on said LCD in response to said character addressing code; and e) a processor for controlling said addressed group of pixels with said direct pixel control code when said identifier identifies said image code as a direct pixel control code and for controlling said addressed group of pixels with a character sub-line code from said character table when said identifier identifies said image code as a character addressing code.

2. An apparatus as claimed in claim 1 wherein said display buffer has a plurality of registers for storing said image codes, said plurality of registers being located in first and second address ranges, said direct pixel control codes being stored in registers within said first address range and said character addressing codes being stored within said second address range such that the address range from which a given image code is retrieved identifies said code as being either a direct pixel control code of a character addressing code.

3. An apparatus as claimed in claim 1 wherein said pixel group address includes a row address portion for addressing a plurality of lines to define a row on which characters are to be represented and wherein said pixel group address generator includes a row address generator for generating said row address portion.

4. An apparatus as claimed in claim 3 wherein said pixel group address includes a line address portion for addressing a line included in said row and wherein said pixel group address generator includes a line address generator for generating said line address portion.

5. An apparatus as claimed in claim 4 wherein said pixel group address includes a position address portion for addressing a position along said line, said position address being associated with said group of pixels and wherein said pixel group address generator includes a position address generator for generating said position address portion.

6. An apparatus as claimed in claim 5 wherein said display buffer is responsive to said row address portion and said position address portion of said pixel group address.

7. An apparatus as claimed in claim 5 wherein said character table has a plurality of registers addressable in groups, each group being associated with a respective character and each register of a given group being operable to store a respective sub-line code associated with a character associated with said group.

8. An apparatus as claimed in claim 7 wherein said character table is responsive to said character addressing code and said line address portion of said pixel group address.

9. An apparatus as claimed in claim 5 further including a programmable processor and a set of instructions operable to direct said programmable processor to implement said pixel group address generator, and said code provider.

10. An apparatus as claimed in claim 9 wherein said programmable processor includes a position counter register, a line counter register and a row counter register, and wherein said set of instructions includes instructions operable to direct said programmable processor to increment the contents of said row counter register up to a first pre-defined value said contents of said row counter being incremented each time said line counter contents have been incremented to a second pre-defined value; and to increment said line counter contents up to said second pre-defined value after said position counter contents have been incremented to a third pre-defined value, said line counter contents being incremented each time said position counter contents have been incremented to said third pre-defined value, said position counter contents being incremented after each direct pixel control code or character subline code is forwarded to said LCD driver.

11. An apparatus as claimed in claim 10 wherein said first pre-defined value corresponds to the number of rows of characters to be displayed on said LCD, said second pre-defined value corresponds to the number of lines in each row, and the third pre-defined value corresponds to the number of pixel groups in a line.

12. An apparatus as claimed in claim 10 further including a set of instructions operable to direct said programmable processor to produce interface signals including:

a) a clock signal having a plurality of signal transitions for signalling to said driver that a next successive pixel on said LCD is to be addressed;

b) a first line signal for indicating to the LCD driver when a first line of said LCD is to be addressed;

c) a latch signal for indicating to the LCD driver when a next line of said LCD is to be addressed; and d) a polarity reversal signal for periodically directing the LCD driver to change the polarity of a reference voltage provided to the LCD.

13. An apparatus as claimed in claim 1 wherein said respective groups of pixels are successively addressed such that said direct pixel control codes and said character sub-line control codes associated with said groups are repeatedly provided to said LCD driver at a time interval.

14. An apparatus as claimed in claim 13 further including an effects processor for altering the interval at which at least one bit in said direct pixel control code or at least one bit of said character subline code is provided to said LCD driver to provide a visual effect to the image displayed by said LCD.

15. An apparatus as claimed in claim 1 further including a data signal generator for generating a data signal for providing to said LCD driver an indication of whether an addressed pixel is to be visible or invisible, in response to a corresponding bit in said direct pixel control code or said character subline control code.

16. An apparatus as claimed in claim 15 further including a clock signal generator for generating a clock signal having a plurality of signal transitions for signalling to said driver that a next successive pixel on said LCD is to be addressed.

17. An apparatus as claimed in claim 16 further including a first line signal generator for generating a first line signal for indicating to the LCD driver when a first line of said LCD is to be addressed.

18. An apparatus as claimed in claim 17 further including a latch signal generator for generating a latch signal for indicating to the LCD driver when a next line of said LCD is to be addressed.

19. An apparatus as claimed in claim 18 further including a polarity reversal signal generator for generating a polarity reversal signal for directing the LCD driver to change the polarity of a reference voltage provided to the LCD.

20. An apparatus as claimed in claim 1 further including a programmable processor and a set of instructions operable to direct said programmable processor to implement said pixel group address generator, and said code provider.

21. An apparatus as claimed in claim 20 further including a set of instructions operable to direct said programmable processor to successively address said respective groups of pixels such that said direct pixel control codes and said character sub-line control codes are repeatedly provided to said LCD driver at an approximately constant interval.

22. An apparatus as claimed in claim 21 further including a set of instructions operable to direct said programmable processor to implement an effects processor by altering the interval at which at least one bit in said direct pixel control code or at least one bit of said character subline code is provided to said LCD driver to provide a visual effect to the image displayed by said LCD.

23. An apparatus as claimed in claim 22 further including a set of instructions operable to direct said programmable processor to produce interface signals including:

a) a clock signal having a plurality of signal transitions for signalling to said driver that a next successive pixel on said LCD is to be addressed;

b) a first line signal for indicating to the LCD driver when a first line of said LCD is to be addressed;

c) a latch signal for indicating to the LCD driver when a next line of said LCD is to be addressed;

d) a polarity reversal signal for directing the LCD driver to change the polarity of a reference voltage provided to the LCD.

24. A method of controlling a Liquid Crystal Display controller operable to control an LCD having a plurality of individually addressable pixels arranged in lines, the method comprising the steps of:

a) generating a pixel group address for addressing respective groups of pixels on said lines of said LCD;

b) storing image codes in a display buffer, said image codes representing a desired image to be displayed on said LCD and said image codes being accessed in response to respective pixel group addresses;

c) identifying each of said image codes as being a direct pixel control code or a character addressing code;

d) storing character sub-line codes in a character table, said character sub-line codes for controlling pixels forming sub-lines of a character to be displayed on said LCD in response to said character addressing code; and e) controlling said addressed group of pixels with said direct pixel control code, when said image code is a direct pixel control code; and addressing said character table with said character addressing code and controlling said addressed group of pixels with a character sub-line code from said character table when said image code is a character addressing code.

25. A method as claimed in claim 24 wherein the step of storing includes storing said image codes in a plurality of registers located in first and second address ranges, said direct pixel control codes being stored in registers within said first address range and said character addressing codes being stored within said second address range such that the address range from which a given image code is retrieved identifies said code as being either a direct pixel control code of a character addressing code.

26. A method as claimed in claim 24 further including the step of generating a row address portion of said pixel group address and using said row address portion for addressing a plurality of lines defining a row on which characters are to be represented.

27. A method as claimed in claim 26 further including the step of generating a line address portion of said pixel group address for addressing a line included in said row.

28. A method as claimed in claim 27 further including the step of generating a position address portion of said pixel group address for addressing a position along said line, said position being associated with said group of pixels.

29. A method as claimed in claim 28 further including the step of causing said display buffer to be responsive to said row address portion and said position address portion of said pixel group address.

30. A method as claimed in claim 28 further including the step of storing respective sub-line codes of characters in respective groups of registers, each group being associated with a respective character, said registers being addressed in groups.

31. A method as claimed in claim 30 further including the step of causing said character table to be responsive to said character addressing code and said line address portion of said pixel group address.

32. A method as claimed in claim 28 further including the step of controlling the operation of a programmable processor with a set of instructions operable to direct said programmable processor to implement said pixel group generator, and to control the addressed group of pixels with either the direct pixel control code or character subline code.

33. A method as claimed in claim 32 further including the step of directing said programmable processor to increment the contents of a row counter register up to a first pre-defined value said contents of said row counter being incremented each time said line counter contents have been incremented to a second pre-defined value; and to increment the contents of a line counter register contents up to said second pre-defined value after the contents of a position counter have been incremented to a third pre-defined value, said line counter register contents being incremented each time said position counter register contents have been incremented to said third pre-defined value, said position counter register contents being incremented after each direct pixel control code or character subline code is forwarded to said LCD driver.

34. A method as claimed in claim 32 further including the step of directing said programmable processor to produce interface signals including:

a) a clock signal having a plurality of signal transitions for signalling to said driver that a next successive pixel on said LCD is to be addressed;

b) a first line signal for indicating to the LCD driver when a first line of said LCD is to be addressed;

c) a latch signal for indicating to the LCD driver when a next line of said LCD is to be addressed; and d) a polarity reversal signal for periodically directing the LCD driver to change the polarity of a reference voltage provided to the LCD.

35. A method as claimed in claim 24 further including the step of successively addressing pixel groups such that said direct pixel control codes and said character sub-line control codes associated with said groups are repeatedly provided to said LCD driver at a time interval.

36. A method as claimed in claim 35 further including the step of altering the interval at which at least one bit in said direct pixel control code or at least one bit of said character subline code is provided to said LCD driver to provide a visual effect to the image displayed by said LCD.

37. A method as claimed in claim 24 further including the step of generating a data signal for providing to said LCD driver an indication of whether an addressed pixel is to be visible or invisible, in response to a corresponding bit in said direct pixel control code or said character subline control code.

38. A method as claimed in claim 37 further including the step of generating a clock signal having a plurality of signal transitions for signalling to said driver that a next successive pixel on said LCD is to be addressed.

39. A method as claimed in claim 38 further including the step of generating a first line signal for indicating to the LCD driver when a first line of said LCD is to be addressed.

40. A method as claimed in claim 39 further including the step of generating a latch signal for indicating to the LCD driver when a next line of said LCD is to be addressed.

41. A method as claimed in claim 40 further including the step of generating a polarity reversal signal for directing the LCD driver to change the polarity of a reference voltage provided to the LCD.

42. A method as claimed in claim 24 further including the step of directing a programmable processor to successively address said respective groups of pixels such that said direct pixel control codes and said character sub-line control codes are repeatedly provided to said LCD driver at an approximately constant interval.

43. A method as claimed in claim 42 further including the step of directing said programmable processor to implement an effects processor by altering the interval at which at least one bit in said direct pixel control code or at least one bit of said character subline code is provided to said LCD driver to provide a visual effect to the image displayed by said LCD.

44. A method as claimed in claim 43 further including the step of directing said programmable processor to produce interface signals including:

a) a clock signal having a plurality of signal transitions for signalling to said driver that a next successive pixel on said LCD is to be addressed;

b) a first line signal for indicating to the LCD driver when a first line of said LCD is to be addressed;

c) a latch signal for indicating to the LCD driver when a next line of said LCD is to be addressed;

d) a polarity reversal signal for directing the LCD driver to change the polarity of a reference voltage provided to the LCD.

* * * * *